US007617654B2

(12) United States Patent
Boccardi

(10) Patent No.: US 7,617,654 B2
(45) Date of Patent: Nov. 17, 2009

(54) SCREWING/ROLLING HEAD FOR PRE-THREADED CAPS

(75) Inventor: Massimo Boccardi, Pavia (IT)

(73) Assignee: Tecnomax-Due S.N.C. di Novarini S. & Boccardi M., Pavia (IT)

( * ) Notice: Subject to any disclaimer, the term of this patent is extended or adjusted under 35 U.S.C. 154(b) by 0 days.

(21) Appl. No.: 12/113,304

(22) Filed: May 1, 2008

(65) Prior Publication Data

US 2008/0250756 A1 Oct. 16, 2008

Related U.S. Application Data

(63) Continuation of application No. PCT/IT2005/000660, filed on Nov. 11, 2005.

(51) Int. Cl.
*B67B 1/06* (2006.01)

(52) U.S. Cl. ..... 53/317; 53/319; 53/331.5

(58) Field of Classification Search ..... 53/317, 53/318, 319, 325, 331.5, 314, 306
See application file for complete search history.

(56) References Cited

U.S. PATENT DOCUMENTS

| | | | | | |
|---|---|---|---|---|---|
| 1,651,903 | A | | 12/1927 | Pennock | |
| 2,106,365 | A | * | 1/1938 | Tiano | 53/317 |
| 2,819,577 | A | * | 1/1958 | Dimond | 53/317 |
| 3,440,798 | A | * | 4/1969 | Rackley | 53/312 |
| 3,530,637 | A | * | 9/1970 | Rezner et al. | 53/488 |
| 4,178,732 | A | * | 12/1979 | Pfleger | 53/309 |
| 4,485,609 | A | * | 12/1984 | Kowal | 53/331.5 |
| 4,559,759 | A | * | 12/1985 | Herbert | 53/308 |
| 4,674,264 | A | * | 6/1987 | Ellis et al. | 53/331.5 |
| 5,417,031 | A | * | 5/1995 | Bankuty et al. | 53/331.5 |
| 5,419,094 | A | * | 5/1995 | Vander Bush et al. | 53/75 |
| 5,490,369 | A | * | 2/1996 | Ellis et al. | 53/317 |
| 5,996,311 | A | * | 12/1999 | Heard et al. | 53/317 |
| 2005/0229540 | A1 | | 10/2005 | Monti | |

FOREIGN PATENT DOCUMENTS

| | | |
|---|---|---|
| DE | 3924120 | 1/1991 |
| GB | 746156 | 3/1956 |

* cited by examiner

*Primary Examiner*—Sameh H. Tawfik
(74) *Attorney, Agent, or Firm*—Jonathan D. Ball; King & Spalding LLP

(57) ABSTRACT

The present invention relates to a screwing/rolling head 1 for screwing and sealing a pre-threaded cap 5 on to a threaded neck 6 of a container 7, the head 1 having a cap pressing member 4 capable of engaging the cap 5 and screwing it on to the container 7. The said cap pressing member 4 is associated for operation with a body 2 of the head 1 in such a way that it can be moved with respect to the body 2 between a first contracted configuration and a second extended configuration, in which the movement is rotary-translational with only one degree of freedom.

The present invention also relates to a head 1 in which asymmetrical clutch means 18 are interposed between the cap pressing member 4 and the body 2, and a head 1 in which the body 2 comprises a first element 8 and a second element 9 connected to it with respect to rotation by means of a disengageable torque limiter 24.

7 Claims, 6 Drawing Sheets

SCREWING/ROLLING HEAD FOR PRE-THREADED CAPS

This application is a continuation application under 35 U.S.C. §120 of the international application PCT/IT2005/000660 filed Nov. 11, 2005, the entire contents of which are hereby incorporated by reference herein.

TECHNICAL FIELD

The present invention relates to a screwing/rolling head for screwing and sealing a pre-threaded cap on to a threaded neck of a container, the head comprising a body extended along a specified longitudinal axis and connectable to a capping machine so that it can be rotated about said axis and can be moved axially between a first retracted position and a second advanced operating position and a cap pressing member capable of engaging said cap to screw it onto said threaded neck; the present invention also relates to a screwing/rolling head for screwing and sealing a pre-threaded cap onto a threaded neck of a container, the head comprising a body extended along a specified longitudinal axis and connectable to a capping machine so that it can be rotated about said axis and can be moved axially between a first retracted position and a second advanced operating position and a cap pressing member capable of engaging said cap to screw it onto said threaded neck; the present invention also relates to a screwing/rolling head for screwing and sealing a pre-threaded cap onto a threaded neck of a container, the head comprising a body connectable to a capping machine and extended along a specified longitudinal axis, said body being rotatable about the axis and being moveable axially between a first retracted position and a second advanced operating position, the body comprising a first element, which can be fixed to the machine, and a second element connected to the first element, and a torque limiter capable of rotationally coupling the first element to the second element.

BACKGROUND OF THE INVENTION

There is a prior art method of sealing bottles by means of plain caps which, when they are applied to the threaded necks of bottles to seal them, are deformed by rolling so that they match the shape of the threaded neck. Essentially, the rolling operation enables the profile of the threads of the threaded necks of bottles to be copied, or more correctly to be formed, in the caps.

In general, each cap has an end ring of specified height, which is connected by breakable links to the skirt of the threaded cap. The function of the end ring is to form a security seal which can demonstrate the integrity of the seal formed by the cap.

For this purpose, during the rolling operation the end ring is pressed and deformed against an edge of the threaded neck which forms a stop to prevent the axial movement of the end ring. Consequently, the unscrewing of the threaded cap from the neck of the bottle causes the links to break, thus making the opening of the bottle evident.

The prior art includes single capping machines, in other words those which can operate on one bottle at a time, and multiple machines, in other words those which can operate on more than one bottle at a time.

Some machines of the second type receive the bottles, with the caps already placed on their necks, from a conveyor belt; the bottles are picked up from the belt and placed on a rotating support, which carries them along a circular path so that they revolve around the principal axis of the machine.

During this circular movement, the capping machine operates the screwing/rolling heads in a known way, so that, during the revolution around the principal axis of the machine, one head is present above each bottle. The heads are also made to rotate about their own axes; in other words, they rotate with respect to the bottles.

During its rotation around the machine, each head is first brought towards the bottle, to carry out the thread copying and rolling required to create the seal; the head is then moved away from the bottle, leaving the latter free to continue in the production cycle.

Earlier machines, designed to have high output rates, have operating parameters which are not modifiable and which have been optimized specifically for capping operations using plain, unthreaded caps.

Recently, new caps have been introduced, reproducing externally the appearance of conventional bottles with corks; however, these caps are threaded internally so as to be adapted to the bottles with threaded necks present on the market.

The capping machines for applying these new caps must therefore be capable of screwing the cap fully on to the bottle before starting the operation of rolling the seal on the security collar.

A head capable of carrying out these operations is described in the patent WO 2004/005181, in the name of Pechiney. However, this head has the drawback of not being usable on the multiple capping machines developed for use with copying and rolling heads, since it is specific to newly designed machines and requires operating parameters which are completely different from those for which the existing machines were designed.

In the first place, it is necessary to consider that the operation of existing capping machines can be described in terms of four operating phases:

- a first phase in which the copying and rolling head, rotating with respect to the bottle, approaches the cap with a downward rotary-translational movement; this phase is optimized to be as fast as possible;
- a second phase, in which the head copies the thread and forms the security seal; in this phase, the head is rotating with respect to the bottle but does not make any axial movement with respect to it;
- a third phase, symmetrical to the first one, in which the head moves away from the bottle;
- a fourth phase, in which the capped bottle completes its cycle and is transferred to the output belt to allow another bottle to take its place on the rotating support; in this phase, the head does not make any axial movement.

In view of the state of the art described above, the object of the present invention is to provide a screwing/rolling head which has structural and functional characteristics such that it can also be applied to capping machines of the old type with non-modifiable operating parameters, and which enables these machines of the old type to be used for applying the new types of plain threaded caps to standard threaded containers or bottles.

SUMMARY OF THE INVENTION

According to the present invention, this object is achieved by means of a screwing/rolling head for screwing and sealing a pre-threaded cap on to a threaded neck of a container, said head comprising a body extended along a specified longitudinal axis and connectable to a capping machine so that it can be rotated about said axis and can be moved axially between a first retracted position and a second advanced operating position; a cap pressing member capable of engaging said cap to screw it onto said threaded neck; wherein said cap pressing member extends along said longitudinal axis to form an extension of said body and is associated for operation with said body by connecting means so to be movable relatively to said body between a first position defining a contracted configuration and a second position defining an extended configuration, said connecting means being capable of limiting said relative movement to a rotary-translational movement having only one degree of freedom, so as to ease the screwing of said cap onto said container during the movement of said member from said extended configuration to said contracted configuration, or by a screwing/rolling head for screwing and sealing a pre-threaded cap onto a threaded neck of a container, said head comprising a body extended along a specified longitudinal axis and connectable to a capping machine so that it can be rotated about said axis and can be moved axially between a first retracted position and a second advanced operating position, a cap pressing member capable of engaging said cap to screw it onto said threaded neck, wherein asymmetrical coupling means are interposed between said cap pressing member and said body, said asymmetrical coupling means being capable of transmitting from said body to said cap pressing member a screwing torque for screwing said pre-threaded cap onto said container during the movement of said member from said extended configuration to said contracted configuration, and leaving said cap pressing member substantially free to rotate with respect to said body during the movement of said cap pressing member from said contracted configuration to said extended configuration, or by a screwing/rolling head for screwing and sealing a pre-threaded cap onto a threaded neck of a container, said head comprising a body connectable to a capping machine and extended along a specified longitudinal axis, said body being rotatable about said axis and being moveable axially between a first retracted position and a second advanced operating position, said body comprising a first element, which can be fixed to said machine, and a second element connected to said first element, a torque limiter capable of rotationally coupling said first element to said second element, wherein said torque limiter is disengageable to disengage the rotation of said first element from that of said second element.

BRIEF DESCRIPTION OF THE DRAWINGS

The characteristics and advantages of the present invention will be made clear by the following detailed description of some practical embodiments, provided by way of example and without restrictive intent, with reference to the attached drawings, in which.

DETAILED DESCRIPTION

Figure 1:
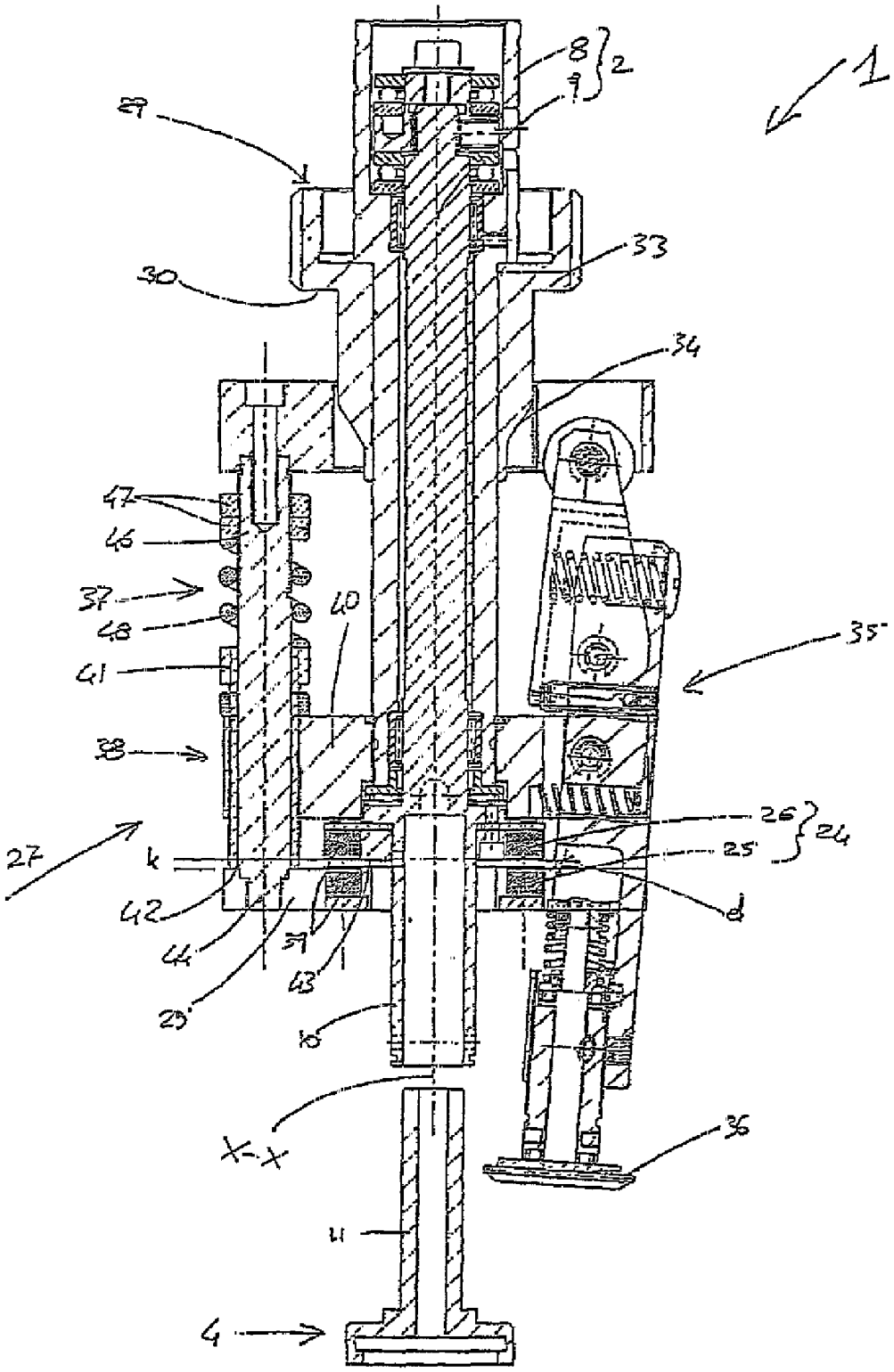
FIG. 1 shows a schematic view in partial section and in partially exploded form of a head according to the present invention.

In the present description, the up-down direction is defined as the direction joining the axis of the screwing/rolling head to the axis of the container during normal use; in particular, the direction from the head to the container is defined as "down", and the direction from the container to the head is defined as "up". In an embodiment of the present invention, shown in FIG. 1 and FIG. 2, the screwing/rolling head 1 comprises a body 2 extending along a specified longitudinal axis X-X and connectable to a capping machine 3 so as to be driven in rotation about the longitudinal axis X-X and to be moved axially between a first retracted position, shown in FIG. 3*a* and a second advanced operating position, shown in FIG. 3*c*.

The head 1 also comprises a cap pressing member 4 which can engage a cap 5, exerting a longitudinal pressure to screw the cap 5 on to the threaded neck 6 of a container 7.

The body 2 comprises a first element 8, preferably tubular with a circular cross section, and a second element 9, inserted coaxially into the first element 8 so that it can rotate with respect to it.

The second element 9 is preferably fixed in the axial direction with respect to the first element 8.

In the embodiments shown in the figures, the second element 9 terminates in a tubular end 10 with a circular cross section, into which the cylindrical shank 11 of the cap pressing member 4 can be fitted, to create a male-female coupling. Between the second element 9 and the cylindrical shank 11 there are interposed connecting means which can limit the relative movement between the continuation 10 of the body 2 and the cylindrical shank 11 of the cap pressing member 4 to a rotary-translational movement having only one degree of freedom.

These connecting means comprise, as shown more fully, by way of example, in FIGS. 4, 5, 6*a* and 6*b*, a guide 12, advantageously formed in the cylindrical shank 11 of the cap pressing member 4 and preferably in the form of a spiral, into which a pin 13 is inserted transversely. The pin 13 is fixed to the second element 9, at least at the moment when the head 1 carries out its screwing function, in other words while the head 1 is pushed towards the container. As shown in FIGS. 4, 5, 6*a* and 6*b*, the pin 13 can consist of a small cylindrical metal bar.

The cap pressing member 4 can therefore move with respect to the second element 9 with a rotary-translational movement with only one degree of freedom.

Figure 6A:
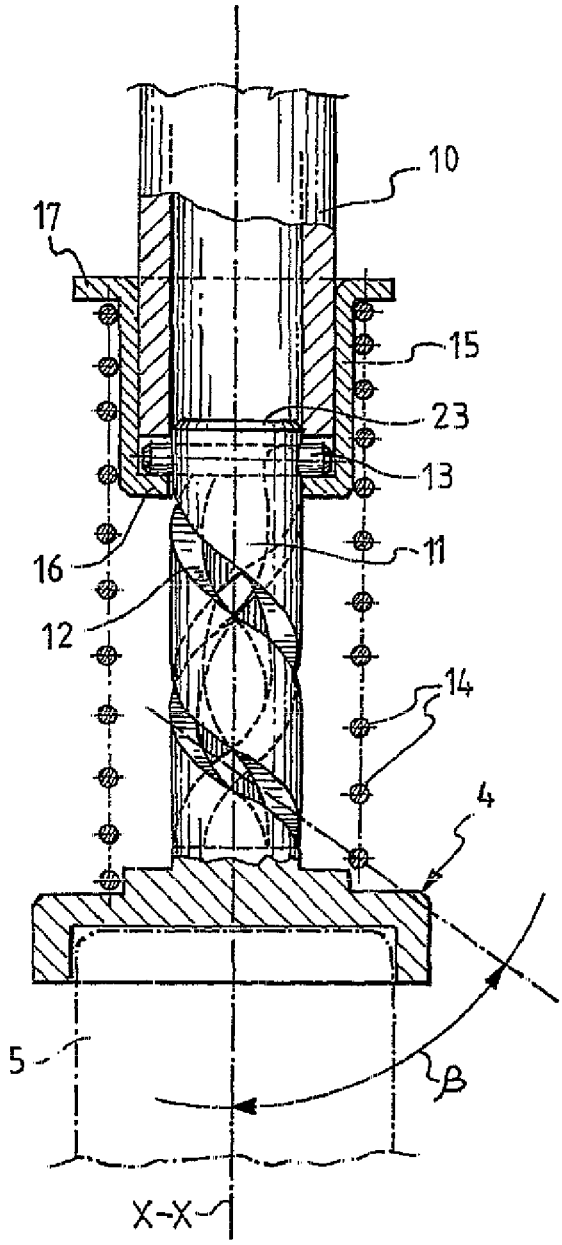
FIGS. 6*a* and 6*b* show two views in partial section of the detail of FIG. 5, positioned in two possible configurations.
Figure 6B:
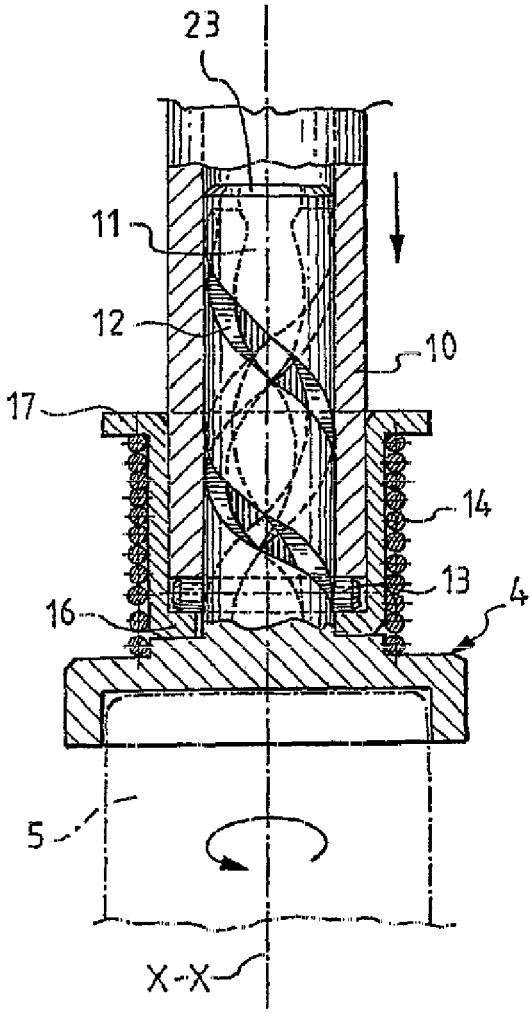

The two end points of this movement are a contracted configuration, shown in FIG. 6*b*, in which the cap pressing member 4 is in its closest position to the second element 9, and an extended configuration, shown in FIG. 6*a*, in which the cap pressing member 4 is in its farthest position from the second element 9. The cap pressing member 4 is pushed by resilient means towards the extended configuration, for example by a helical spring 14 outside the shank 11 and coaxial with it, as shown in FIGS. 4, 5, 6*a* and 6*b*.

Figure 4:
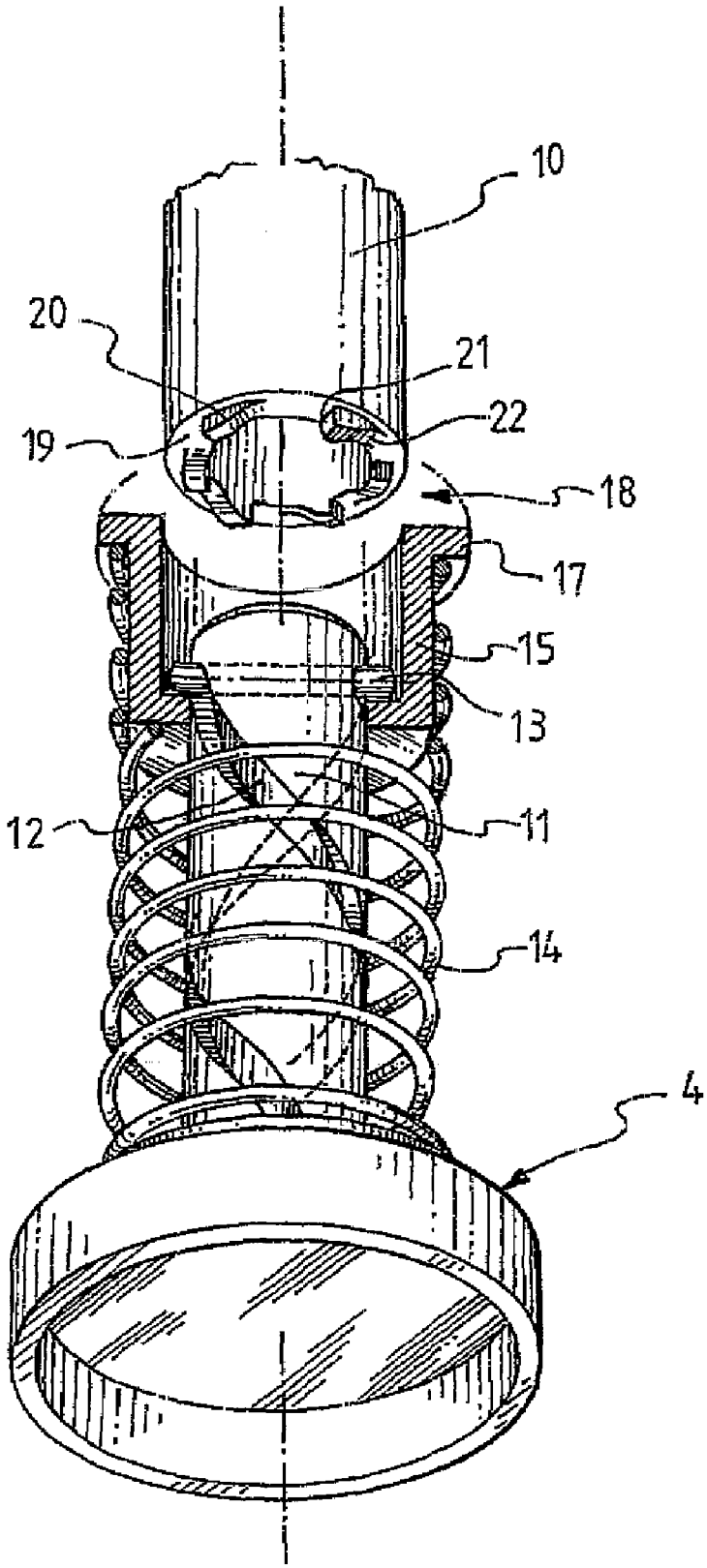
FIG. 4 shows a schematic perspective view of a detail of the present invention, in a head substantially resembling the head of FIG. 1.
Figure 5:
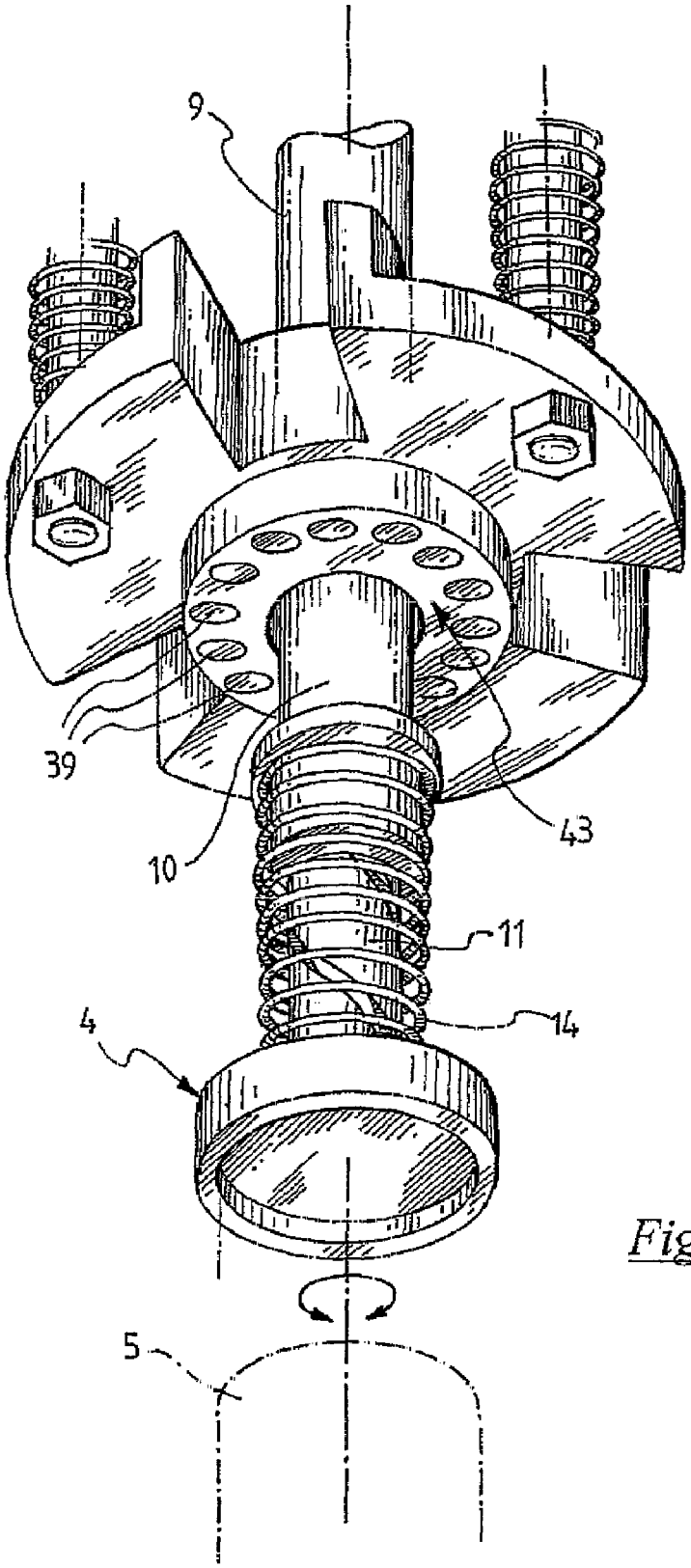
FIG. 5 shows a partially exploded perspective view of a detail of FIG. 4.

The cap pressing member 4 can be provided with means for transmitting the thrust of the helical spring 14 to the pin 13, for example a sleeve 15 provided with a lower inner flange 16 and an upper outer flange 17, positioned, as shown in FIG. 4, around the shank 11.

With this arrangement, the upper outer flange 17 receives the upward thrust from the spring 14, while the lower inner flange 16 transmits this thrust upwards to the pin 13.

The sleeve 15 can advantageously be retained axially with respect to the second element 9 by means known in the art.

The guide 12 can be made in the form of a through slot, a groove or ribbing. It is also feasible to form the coupling between the continuation 10 and the cylindrical shank 11 by means of a threaded coupling.

As an alternative to the above, the guide 12 can be formed in the continuation 10 of the second element 9 and consequently the pin 13 will be made in such a way as to be at least partially fixed to the cylindrical shank 11 of the cap pressing member 4.

Advantageously, the guide 12 is formed along almost the whole length of the cylindrical shank 11 or of the continuation 10.

For reasons of balance, it is convenient to form two or more guides 12 spaced at equal circumferential intervals in the continuation 10 or in the cylindrical shank 12 and a corresponding number of pins 13.

When two diametrically opposed guides 12 are formed on the cylindrical shank 11, it is possible to use a single pin 13 in the form of a peg.

The angle of inclination β of the guide 12 must be chosen so as to avoid an excessive increase in the forces applied, and to allow the cap pressing member 4 to screw the cap 5 on to each container 7, regardless of the position of the cap 5 with respect to the container 7.

The means of connection between the cap pressing member 4 and the body 2 therefore enable the cap pressing member 4 to increase the number of revolutions which the cap 5 is required to make, thus enabling the threaded cap 5 to be screwed on fully during the descent of the head 1 in the first operating phase.

Advantageously, the guide 12 makes at least half revolution, preferably at least one complete revolution, and even more preferably at least one and a half revolutions with respect to the second element 9, during the movement between the extended configuration and the contracted configuration.

The angle of inclination β of the guide with respect to the longitudinal axis X-X depends on the useful height h of the cylindrical shank 11, on the radius r which is taken into consideration, and on the number of revolutions n to be completed, according to the following expression:

$$\tan \beta=(2\pi r\cdot n)/h$$

The useful height h of the cylindrical shank 11 is the longitudinal extension of the guide 12, decreased by the longitudinal extension of its initial and final parts.

This is because the guide 12 has a useful longitudinal extension h which is smaller than the total longitudinal extension, since only its central section is used, while the initial and final parts are made to allow adequate safety margins during the movement.

The angle of inclination β, measured along the outer side of the cylindrical shank 11, is generally in the range from 20° to 60°, preferably from 25° to 35°, or from 40° to 50°, with preferred values of approximately 30° or approximately 45°.

If this coupling is made in the form of a threaded coupling, the angle β will clearly be considered to be the angle of inclination of the thread with respect to the longitudinal axis of the cap pressing member.

In the third operating phase, the cap pressing member 4 must be prevented from unscrewing the cap 5 which has just been screwed on. This is because, whereas in the first phase the rotation of the cap pressing member 4 with respect to the head 1 is added to the rotation of the head 1 with respect to the container 7, in the third phase the rotary movement of the cap pressing member 4 with respect to the head 1 is in the opposite direction, and therefore one rotation is subtracted from the other.

When the guide 12 is made in such a way as to impart to the cap pressing member 4 a relative angular velocity with respect to the second element 9 which is greater than the relative angular velocity between the head 1 and the container 7, the unscrewing effect due to the movement between the cap pressing member 4 and the body 2 is greater than the screwing effect due to the movement of the head 1 with respect to the container 7.

This creates a stress on the links of the cap 5, which could unscrew the cap or break the links.

A possible solution is to calculate the angle of inclination β in such a way that the two rotations exactly compensate each other.

More advantageously, it is possible to interpose between the body 2 and the cap pressing member 4 asymmetric coupling means 18 for transmitting the screwing torque from the body 2 to the cap pressing member 4 during the first operating phase only, leaving the cap pressing member 4 substantially free to rotate with respect to the body 2 during the movement of the member 4 from the contracted configuration to the extended configuration, in other words during the third operating phase.

An example of this embodiment is shown in FIG. 4: teeth 20, each having a wall 21 and a ramp 22, are formed on the lower surface 19 of the continuation 10 of the second element 9. The inclination of the wall 21 and of the ramp 22 with respect to the plane formed by the lower surface 19 is such that the pin 13 abuts against the walls 21 of the teeth 20 during the movement from the extended configuration to the contracted configuration, and, during the opposite movement, the ramp 22 has an inclination such that the pin 13 can slide over the teeth 20.

Consequently, the angle between the plane formed by the lower surface 19 and the wall 21 is greater than the angle between the plane formed by the lower surface 19 and the ramp 22.

If the guide 12 is formed on the shank 11 of the cap pressing member 4, teeth will be formed on the upper surface 23 of the shank 11, correspondingly to the embodiment described above.

In a second embodiment of the present invention, the object of the present invention is achieved by preventing the ovalization of the security seal of the cap which might otherwise occur during the rolling operation.

The head 1 is provided with a torque limiter 24 between the first element 8 and the second element 9.

To prevent it from sliding, thus creating irregularities in the transmitted torque which would deform the security seal during the rolling of the cap 5, it is useful to provide the head 1 with a disengageable torque limiter 24, to allow rotation of the first element 8 to be disengaged from the rotation of the second element 9.

The torque limiter, or coupling, 24 of the present invention comprises a driving element 25 rotationally fixed to the first element 8, and capable of receiving torque from the capping machine 3 and transmitting it to a driven element 26 rotationally fixed to the second element 9.

A moving element 27, which can be moved parallel to said longitudinal axis X-X between a first operating position and a second inoperative position, is connected for operation to the driving element 25, so that the movement of the said moving element 27 from the first operating position to the second inoperative position causes coupling 24 to change from its engaged configuration to its disengaged configuration and vice versa.

The moving element 27 can transmit torque from the first element 8 to the driving element 25 and can impart an axial movement to the driving element 25 to move it away from the driven element 26, thus disengaging the two.

In a preferred embodiment of the present invention, the moving element 27 comprises an abutment surface 28 at an upper end, while the head 1 comprises an actuating element 29, rotationally fixed to said first element 8, having an actuating surface 30 which can be moved by capping machine 3 with respect to body 2 along a direction parallel to longitudinal axis X-X.

When surface 30 contacts surface 28, moving element 27 is pushed downwards along the longitudinal direction X-X.

A strut 31 transmits this longitudinal movement to the driving element 25, which moves away from the driven element 26, thus decreasing the maximum torque which can be transmitted by the torque limiter 24 to zero.

Figure 2:
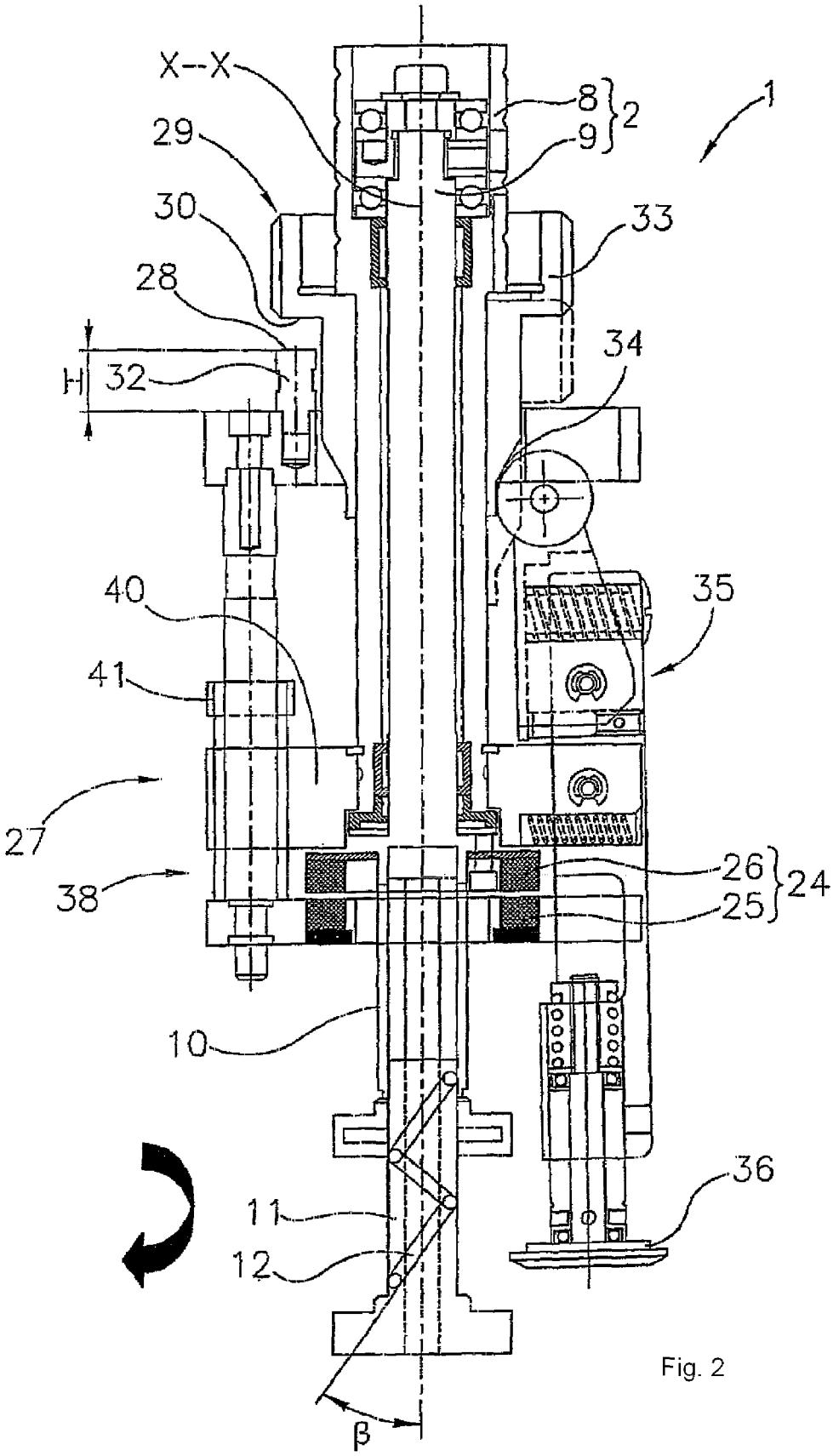
FIG. 2 shows a schematic view in partial section of a head substantially resembling the head of FIG. 1.
Figure 3A:
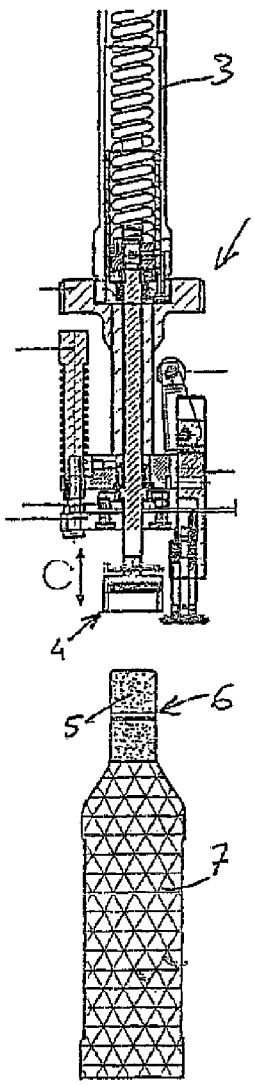
FIGS. 3*a*-3*c* show schematic views in partial section of the head according to the present invention during different phases of the operation of capping a container.
Figure 3B:
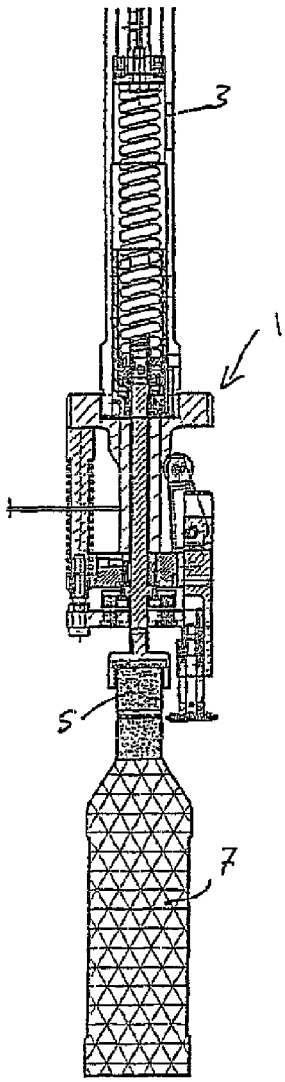
Figure 3C:
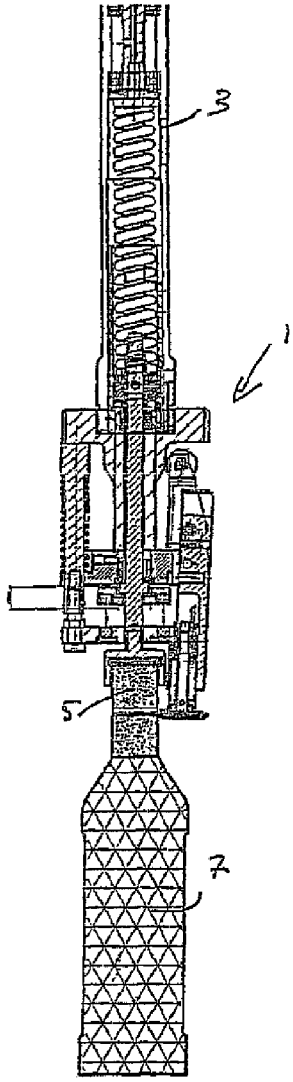

As shown in FIG. 2, the surface 28 can advantageously be made on a removable extension 32, fixed to the upper part of the moving element 27.

Thus, when the extension 32 is removed from the moving element 27, as shown in FIG. 1, the actuating surface 30 is no longer able to actuate the moving element 27.

In this embodiment, an operator can choose whether or not to use the function of disengagement of the torque limiter 24.

The extension 32 has a longitudinal length H which is greater than the travel C required for the complete disengagement of the torque limiter 24. Clearly, travel C depends on the material used for the elements 25 and 26 of coupling 24, and on the type of coupling.

As a general rule, a magnetic coupling requires a distance d between the driven element 26 and the driving element 25 of approximately 1.1-1.4 mm, and it is fully disengaged after a travel C of less than 5 mm.

It is possible to provide an extension 32 having an adjustable longitudinal length H, or to provide an adjustable fixing between the extension 32 and the moving element 27.

In this way the longitudinal position of the extension 32 relative to the moving element 27 can be modified, thus varying the moment at which the torque limiter 24 is disengaged.

Extension 32 can advantageously be provided either with a long travel adjustment, for example the adjustment of its length H, or with a finer adjustment, for example in the area in which it is connected to the moving element 27, with a shorter travel.

The actuating surface 30 is located on an actuating means 29, for example a cam 33.

Cam 33 is rotationally fixed to first element 8, but is longitudinally slidable with respect to it.

Cam 33 can also be provided with an area 34 for actuating arms 35 which carry rolling wheels 36. Such an actuation is known in the art and will not be described further.

The torque limiting coupling 24 advantageously comprises means 37 to keep it in the engaged configuration and means 38 capable of varying the maximum torque which it can transmit when in the engaged configuration.

Torque limiter 24 is preferably made with a magnetic or electromagnetic coupling. The driving element 25 and the driven element 26 are advantageously made by discs which carry a plurality of magnets 39.

The distance d between the two elements 25 and 26 determines the maximum torque that can be transmitted by the torque limiter 24. Distance d can be adjusted by suitable means 38 present on the moving element 27.

The first element 8 is fixed to a preferably annular body 40, to which a sleeve 41 is fixed.

This sleeve 41 has a lower surface 42 which can be adjusted with respect to the body 40 so that it is at a specified longitudinal distance k from the lower surface 43 of the driven element 26.

The sleeve 41 is preferably screwed into a threaded through hole formed in the body 40 and the adjustment is carried out by screwing the sleeve 41 into or out of the body 40.

The strut 31 is fixed at its lower end 44 to the driving element 25, in such a way that the upper surface 45 of the driving element 25 is aligned with the lower surface 42 of the sleeve 40 or is at a fixed distance from it.

The strut 31 has an area 46 which is preferably threaded and is remote from the lower end 44, and which comprises retaining means 47.

Between sleeve 41 and retaining means 47 are interposed resilient means 48, preferably a helical spring coaxial with the strut 31, to bias sleeve 40 and retaining means 47 away from each other.

The present invention has been described with reference to the drawings and to some embodiments.

It will be evident to a person skilled in the art that, while the embodiments solve the same problem of providing a head capable of applying the new type of seals to existing containers, the aspect relating to the relative movement of the cap pressing member and the body is relevant only in the screwing phase, while the aspect relating to the disengageable torque limiter is relevant only in the rolling phase.

The term "screwing/rolling head" therefore denotes either a head capable of carrying out one or the other of the functions only, or a head capable of carrying out both of them.

Clearly, a person skilled in the art can make numerous modifications and variations to the configurations described above, in order to meet contingent and specific requirements, all such modifications and variations being contained within the scope of protection of the invention as defined in the following claims.

The invention claimed is:

1. A screwing/rolling head for screwing and sealing a pre-threaded cap onto a threaded neck of a container, said head comprising:

a body extended along a specified longitudinal axis and connectable to a capping machine so that said body can be rotated about said axis and can be moved axially between a first retracted position and a second advanced operating position;

a cap pressing member capable of engaging a cap to screw the cap onto a threaded neck of a container, said cap pressing member extending along said longitudinal axis to form an extension of said body; and connecting means associating said cap pressing member for operation with said body such that said cap pressing member is movable relative to said body between a first position defining a contracted configuration and a second position defining an extended configuration, said connecting means limiting said relative movement to a rotary-translational movement having only one degree of freedom so as to ease the screwing of the cap onto the container during the movement of said cap pressing member from said extended configuration to said contracted configuration, said connecting means comprising a positive coupling between a guide, provided either in said body or in said cap pressing member, that directs the rotary-translational movement and a pin that, during the movement of said member from said extended configuration to said contracted configuration, is fixed to the other of said body and said cap pressing member, and said connecting means further comprising toothing with asymmetrical teeth having a profile that enables said pin to abut against said teeth during the movement of said cap pressing member from said extended configuration to said contracted configuration and that allows said pin to override said teeth when a predetermined torque is exceeded during movement in the opposite direction.

2. The head according to claim 1, wherein said rotary-translational movement with only one degree of freedom is along a helical path of said guide.

3. The head according to claim 1, wherein said guide is inclined, with respect to said longitudinal axis, at an angle in a range selected from the group consisting of from 20° to 60°, from 25° to 35°, or from 40° to 50 °.

4. The head according to claim 3, wherein said teeth are interposed between said cap pressing member and said body and are configured to:

transmit from said body to said cap pressing member a screwing torque for screwing the pre-threaded cap onto the container during the movement of said cap pressing member from said extended configuration to said contracted configuration, and leave said cap pressing member substantially free to rotate with respect to said body during the movement of said cap pressing member from said contracted configuration to said extended configuration.

5. The head according to claim 2, wherein said connecting means comprises a threaded coupling.

6. The head according to claim 5, wherein said body comprises a first element, which can be fixed to the capping machine, and a second element, and wherein said head further comprises:

a torque limiter rotationally coupling said first element to said second element in an engaged configuration, said torque limiter being disengageable to disengage the rotation of said first element from that of said second element in a disengaged configuration, said torque limiter comprising a driving element, rotationally fixed to said first element, and a driven element, rotationally fixed to said second element;

a moving element, which moves parallel to said longitudinal axis between a first operating position and a second inoperative position, connected to said driving element in such a way that the movement of said moving element from said first operating position to said second inoperative position moves said torque limiter from said engaged configuration to said disengaged configuration and vice versa, said moving element comprising an abutting surface formed on an extension; and an actuating element, rotationally fixed to said first element and having an actuating surface configured to move said moving element when said actuating surface pushes said abutting surface of said moving element along an axis parallel to said longitudinal axis, wherein said extension has a length along an axis parallel to said longitudinal axis that is greater than the travel required for the complete disengagement of said torque limiter, in such a way that, when said extension is not fixed to said moving element, said actuating element is unable to actuate said moving element.

7. The head according to claim 1, wherein said body comprises a first element, which can be fixed to the capping machine, and a second element, and wherein said head further comprises:

a torque limiter rotationally coupling said first element to said second element in an engaged configuration, said torque limiter being disengageable to disengage the rotation of said first element from that of said second element in a disengaged configuration, said torque limiter comprising a driving element, rotationally fixed to said first element, and a driven element, rotationally fixed to said second element;

a moving element, which moves parallel to said longitudinal axis between a first operating position and a second inoperative position, connected to said driving element in such a way that the movement of said moving element from said first operating position to said second inoperative position moves said torque limiter from said engaged configuration to said disengaged configuration and vice versa, said moving element comprising an abutting surface formed on an extension; and an actuating element, rotationally fixed to said first element and having an actuating surface configured to move said moving element when said actuating surface pushes said abutting surface of said moving element along an axis parallel to said longitudinal axis, wherein said extension has a length along an axis parallel to said longitudinal axis that is greater than the travel required for the complete disengagement of said torque limiter, in such a way that, when said extension is not fixed to said moving element, said actuating element is unable to actuate said moving element.

* * * * *